US006279344B1

(12) United States Patent
Drnevich et al.

(10) Patent No.: US 6,279,344 B1
(45) Date of Patent: Aug. 28, 2001

(54) CRYOGENIC AIR SEPARATION SYSTEM FOR PRODUCING OXYGEN

(75) Inventors: Raymond Francis Drnevich, Clarence Center; Minish Mahendra Shah, East Amherst, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/583,548

(22) Filed: Jun. 1, 2000

(51) Int. Cl.[7] ..... F25J 1/00
(52) U.S. Cl. ..... 62/646; 62/654
(58) Field of Search ..... 62/646, 654

(56) References Cited

U.S. PATENT DOCUMENTS

| | | | |
|---|---|---|---|
| 2,079,019 | 5/1937 | Karwat | 75/41 |
| 3,304,074 | 2/1967 | Atherton | 266/30 |
| 4,022,030 | 5/1977 | Brugerolle | 62/30 |
| 5,244,489 | 9/1993 | Grenier | 75/466 |
| 5,265,429 * | 11/1993 | Dray | 62/646 |
| 5,355,682 * | 10/1994 | Agrawal et al. | 62/646 |
| 5,463,871 | 11/1995 | Cheung | 62/38 |
| 5,538,534 | 7/1996 | Guillard et al. | 75/466 |
| 5,582,036 | 12/1996 | Drnevich et al. | 62/656 |
| 5,600,970 | 2/1997 | Drnevich et al. | 62/651 |
| 5,682,766 | 11/1997 | Bonaquist et al. | 62/646 |
| 5,881,570 | 3/1999 | Drnevich et al. | 62/646 |
| 6,045,602 | 4/2000 | Shah et al. | 75/466 |

* cited by examiner

*Primary Examiner*—Ronald Capossela
(74) *Attorney, Agent, or Firm*—Stanley Ktorides

(57) ABSTRACT

A cryogenic air separation system for producing oxygen employing a double column and a side column wherein side column liquid is vaporized against nitrogen heat pump fluid taken from the higher pressure column of the double column and then used to reflux the higher pressure and/or lower pressure columns of the double column.

10 Claims, 2 Drawing Sheets

CRYOGENIC AIR SEPARATION SYSTEM FOR PRODUCING OXYGEN

TECHNICAL FIELD

This invention relates generally to cryogenic air separation and, more particularly, to cryogenic air separation for producing oxygen, particularly at elevated pressure.

BACKGROUND ART

Oxygen is produced commercially in large quantities by the cryogenic separation of air, generally employing a double column arrangement having a higher pressure column in heat exchange relation with a lower pressure column. A recent significant advancement in the production of oxygen is the side column system which enables the production of oxygen with lower operating costs. Examples of side column systems may be found in U.S. Pat. No. 5,463,871—Cheung and U.S. Pat. No. 5,582,036—Drnevich et al.

When the production of elevated pressure oxygen is desired using the side column system, liquid oxygen from the side column is pumped and then vaporized against boosted feed air. The air pressure for the booster air compressor may fluctuate especially where the base load air compressor is also supplying air for another use such as the blast air for a blast furnace. Such fluctuations result in unstable operation.

Accordingly it is an object of this invention to provide a cryogenic air separation system using a side column arrangement which can produce oxygen with improved stability.

SUMMARY Of THE INVENTION

The above and other objects, which will become apparent to those skilled in the art upon a reading of this disclosure, are attained by the present invention, one aspect of which is:

A method for producing oxygen comprising:

(A) passing feed air into a higher pressure column and separating the feed air by cryogenic rectification within the higher pressure column into nitrogen-enriched vapor and oxygen-enriched fluid;

(B) passing oxygen-enriched fluid from the higher pressure column into a lower pressure column and producing oxygen-richer fluid within the lower pressure column;

(C) passing oxygen-richer fluid from the lower portion of the lower pressure column into the upper portion of a side column and producing oxygen-rich liquid within the side column;

(D) withdrawing nitrogen-enriched vapor from the higher pressure column, compressing the nitrogen-enriched vapor, and cooling the compressed nitrogen-enriched vapor by indirect heat exchange with oxygen-rich liquid to produce oxygen-rich vapor; and (E) recovering vaporized oxygen-rich liquid as product oxygen.

Another aspect of the invention is:

Apparatus for producing oxygen comprising:

(A) a higher pressure column, a lower pressure column, means for passing feed air into the higher pressure column, and means for passing fluid from the higher pressure column to the lower pressure column;

(B) a side column and means for passing fluid from the lower portion of the lower pressure column to the upper portion of the side column;

(C) a compressor, a heat exchanger, means for passing fluid from the upper portion of the higher pressure column to the compressor and from the compressor to the heat exchanger;

(D) means for passing fluid from the lower portion of the side column to the heat exchanger; and (E) means for recovering fluid from the heat exchanger as product oxygen.

As used herein the term "feed air" means a mixture comprising primarily nitrogen and oxygen, such as ambient air.

As used herein the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process. The term, "double column" is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "bottom reboiler" means a heat exchange device which generates column upflow vapor from column bottom liquid.

As used herein the terms "turboexpansion" and "turboexpander" mean respectively method and apparatus for the flow of high pressure gas through a turbine to reduce the pressure and the temperature of the gas thereby generating refrigeration.

As used herein the terms "upper portion" and "lower portion" mean those sections of a column respectively above and below the mid point of the column.

DETAILED DESCRIPTION

In general the invention comprises the use of a nitrogen heat pump circuit operated using nitrogen-enriched fluid from the higher pressure column of a double column, to vaporize liquid oxygen within and/or taken from a side column to produce oxygen vapor. The nitrogen heat pump circuit relieves the feed air from some liquid oxygen vaporization duty, thus removing pressure fluctuations in the base load air compressor from disrupting the operation of the cryogenic air separation facility. Such pressure fluctuations are especially experienced when the base load air compressor is providing air to a facility, such as a blast furnace, in addition to the cryogenic air separation facility.

Figure 1:
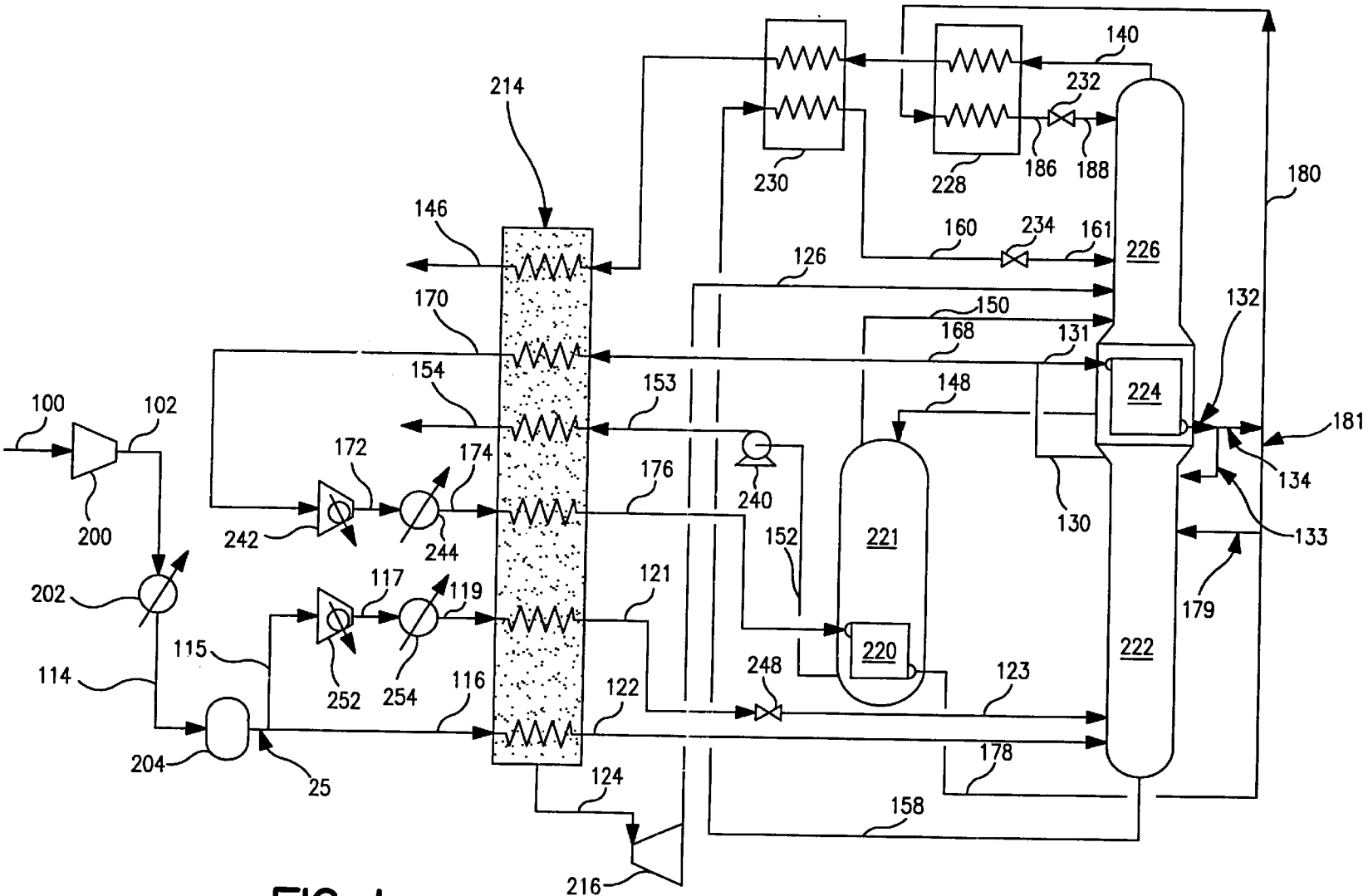
FIG. 1 is a schematic representation of one preferred embodiment of the cryogenic oxygen production system of this invention.

The invention will be described in detail with reference to the Drawings. Referring now to FIG. 1, feed air 100 is compressed in base load air compressor 200 to a pressure generally within the range of from 35 to 100 pounds per square inch absolute (psia). Compressed feed air 102 is then cooled of the heat of compression by passage through cooler 202 and then as stream 114 is passed to prepurifier 204 wherein it is cleaned of high boiling impurities such as carbon dioxide, water vapor and hydrocarbons. Cleaned compressed feed air 25 is divided into portion 115 and 116. Portion 115 is increased in pressure by passage through booster compressor 252. Boosted feed air portion 117 is cooled of the heat of compression in cooler 254 and then as stream 119 is passed to main heat exchanger 214 wherein it is cooled by indirect heat exchange with oxygen-rich liquid taken from the side column as will be more fully described below. Resulting cooled feed air portion 121 is passed through valve 248 and as stream 123 into higher pressure column 222. Feed air portion 116 is passed into main heat exchanger 214 wherein it is cooled by indirect heat exchange with return streams. A portion 124 is withdrawn after partial traverse of main heat exchanger 214 and turboexpanded to generate refrigeration in turboexpander 216. Resulting turboexpanded feed air portion 126 is passed into lower pressure column 226. The remaining portion of stream 116 is passed from main heat exchanger 214 in stream 122 into higher pressure column 222.

Higher pressure column 222, which is part of a double column system which also includes lower pressure column 226, is operating at a pressure generally within the range of from 30 to 95 psia. Within higher pressure column 222 the feed air is separated by cryogenic rectification into nitrogen-enriched vapor and oxygen-enriched fluid. Oxygen-enriched fluid is withdrawn from the lower portion of higher pressure column 222 in liquid stream 158, subcooled by passage through heat exchanger 230, and passed in stream 160 through valve 234 and as stream 161 into lower pressure column 226. Nitrogen-enriched vapor is withdrawn from the upper portion of higher pressure column 222 in stream 130 and passed into main condenser 224 as shown by stream 131. If desired, a portion of the nitrogen-enriched vapor may be recovered as product higher pressure nitrogen. Within main condenser 224 the nitrogen-enriched vapor is condensed by indirect heat exchange with boiling column 226 bottom liquid. Resulting condensed nitrogen-enriched liquid is withdrawn from main condenser 224 in stream 132. One portion is passed into higher pressure column 222 as reflux in stream 133 and another portion 134 is combined with stream 181 (described below) to form stream 180 for passage into lower pressure column 226 as reflux.

In the practice of this invention nitrogen-enriched vapor from the higher pressure column is used to operate a heat pump circuit to boil oxygen-rich liquid typically in the main heat exchanger and/or the side column reboiler, although this could take place in a separate product boiler. In the embodiment of the invention illustrated in FIG. 1, this nitrogen-enriched vapor is taken as a portion of stream 130. The nitrogen-enriched vapor for the heat pump circuit could be taken from the higher pressure column in a separate stream from stream 130. If the nitrogen-enriched fluid for heat pumping is taken separately from stream 130, then the nitrogen-enriched liquid of the heat pump circuit will be passed into the higher and/or lower pressure columns separately from the fluid in stream 132. In the embodiment of the invention illustrated in FIG. 1, nitrogen-enriched vapor in stream 168 is warmed by passage through main heat exchanger 214 and resulting warmed nitrogen-enriched vapor stream 170 is compressed by passage through compressor 242 to a pressure generally within the range of from 50 to 1000 psia. Resulting compressed stream 172 is cooled of the heat of compression in cooler 244 and passed as stream 174 to main heat exchanger 214 wherein it is cooled by indirect heat exchange with return streams. Resulting nitrogen-enriched fluid 176 is passed into bottom reboiler 220 of side column 221 wherein it is cooled by indirect heat exchange with oxygen-rich liquid to generate oxygen-rich vapor for vapor upflow for the side column. Resulting nitrogen-enriched liquid is passed out of bottom reboiler 220 in stream 178. A portion 179 is passed into higher pressure column 222 as reflux. Another portion 181 is combined with stream 134 to form stream 180. Stream 180 is subcooled by passage through heat exchanger 228 to form subcooled stream 186 which is passed through valve 232 and as stream 188 into lower pressure column 226 as reflux.

Lower pressure column 226 is operating at a pressure less than that of higher pressure column 222 and generally within the range of from 16 to 25 psia. Within lower pressure column 226 the various feeds into that column are separated by cryogenic rectification into nitrogen-richer fluid and oxygen-richer fluid. Nitrogen-richer fluid is withdrawn from the upper portion of lower pressure column 226 in vapor stream 140, warmed by passage through heat exchangers 228, 230 and 214 and withdrawn from the system in stream 146 which may be recovered in whole or in part as product nitrogen having a nitrogen concentration within the range of from 95 to 99.999 mole percent. If desired some oxygen-richer fluid may be recovered from the lower portion of lower pressure column 226 as product oxygen having an oxygen concentration generally within the range of from 50 to 90 mole percent.

Oxygen-richer fluid is withdrawn from the lower portion of lower pressure column 226 as liquid stream 148 and passed into the upper portion of side column 221 which is operating at a pressure similar to that of lower pressure column 226. The oxygen-richer liquid passes down through side column 221 against the upflowing vapor generated by the operation of bottom reboiler 220 and, in the process, lighter components such as nitrogen and argon are stripped out of the downflowing liquid into the upflowing vapor which is then passed in stream 150 from the upper portion of side column 221 to the lower portion of lower pressure column 226. Typically stream 150 has an oxygen concentration within the range of from 20 to 65 mole percent and a nitrogen concentration within the range of from 30 to 80 mole percent. The stripping action within side column 221 serves to produce oxygen-rich liquid by cryogenic rectification in the lower portion of side column 221. Oxygen-rich liquid, generally having an oxygen concentration within the range of from 70 to 98 mole percent, is withdrawn from the lower portion of side column 221 in stream 152 and pumped to a higher pressure by operation of liquid pump 240. Resulting pressurized oxygen-rich liquid is passed in stream 153 to main heat exchanger 214 wherein it is vaporized by indirect heat exchange with the boosted feed air stream 119 as was previously described. The resulting oxygen-rich vapor is recovered as product oxygen in stream 154.

Figure 2:
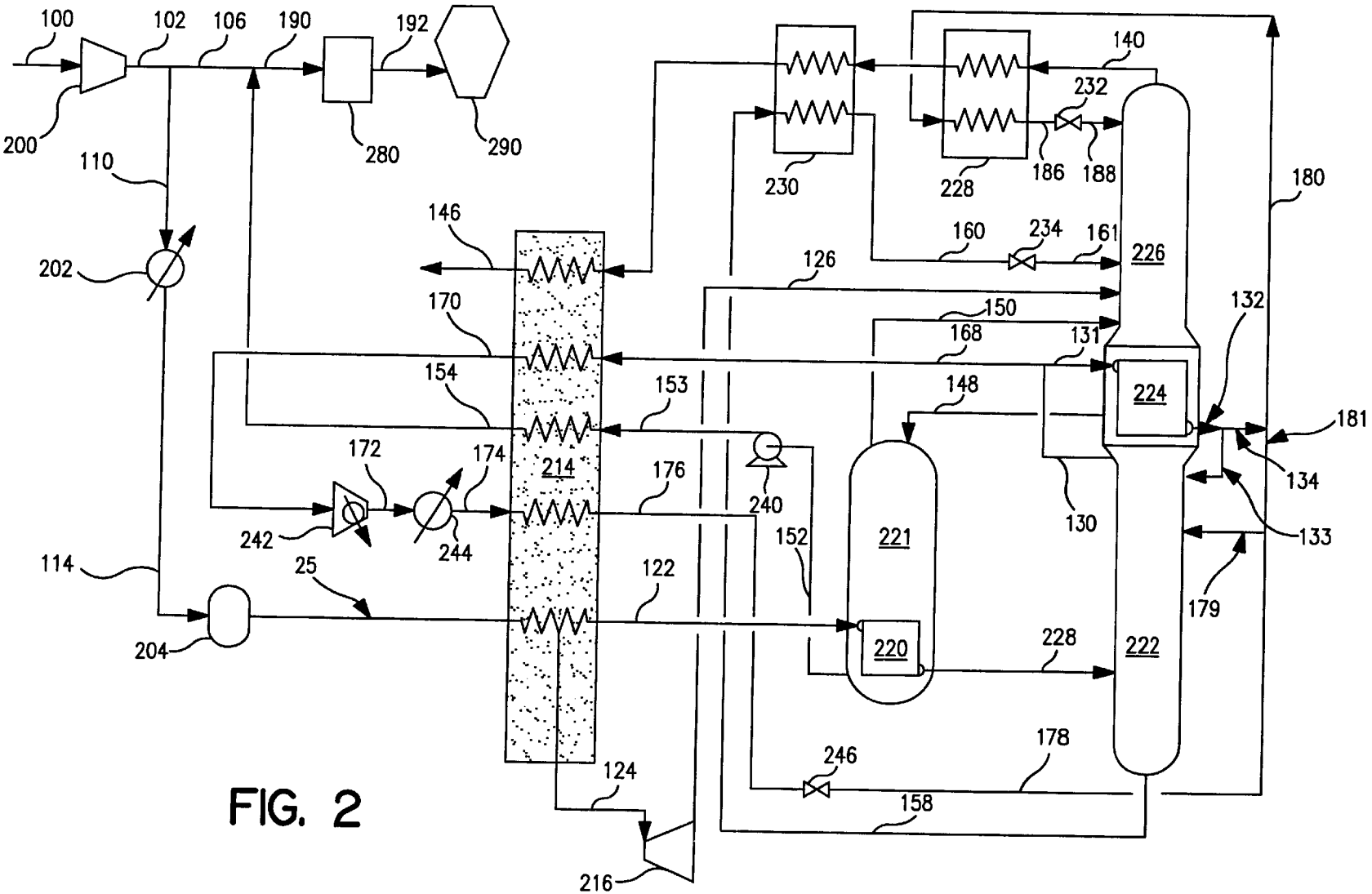
FIG. 2 is a schematic representation of another preferred embodiment of the cryogenic oxygen production system of this invention wherein the invention is integrated with a blast furnace system.

FIG. 2 illustrates another embodiment of the invention and also illustrates a particularly advantageous application of the invention wherein the invention is integrated with a blast furnace system. In this application the base load air compressor also supplies air to the blast furnace, and product oxygen produced by the invention is supplied to the blast furnace. The numerals in FIG. 2 are the same as those of FIG. 1 for the common elements and these common elements will not be described again in detail.

Referring now to FIG. 2, compressed feed air 102 is divided into portion 106, which may comprise from 25 to 90 percent of compressed feed air 102, and into portion 110 which may comprise from 10 to 75 percent of compressed feed air 102. Portion 110 is used as the feed air to the cryogenic air separation system. In the embodiment of the invention illustrated in FIG. 2, the cleaned feed air 25 is not divided upstream of main heat exchanger 214 but, rather, is passed thereto in its entirety. In addition, cooled feed air stream 122 is employed as the fluid driving side column reboiler 220 rather than the heat pump fluid used in the embodiment illustrated in FIG. 1. After feed air stream 122 is used to reboil the bottom liquid of side column 221 it is passed as stream 128 into higher pressure column 222. Oxygen-rich liquid 153 is vaporized by indirect heat exchange with compressed nitrogen-enriched heat pump fluid 174 in main heat exchanger 214. Cooled, condensed nitrogen-enriched heat pump fluid 176 is not passed to bottom reboiler 220 but, rather, is passed through valve 246 and then as stream 178 is processed as was previously described. Product oxygen 154 is combined with blast air stream 106 to form oxygen-enriched blast air stream 190. The oxygen-enriched blast air is then heated in stoves 280 and resulting heated oxygen-enriched blast air 192 is passed to blast furnace 290.

Although the invention has been described in detail with reference to certain preferred embodiments, those skilled in the art will recognize that there are other embodiments of the invention within the spirit and the scope of the claims.

What is claimed is:

1. A method for producing oxygen comprising:

(A) passing feed air into a higher pressure column and separating the feed air by cryogenic rectification within the higher pressure column into nitrogen-enriched vapor and oxygen-enriched fluid;

(B) passing oxygen-enriched fluid from the higher pressure column into a lower pressure column and producing oxygen-richer fluid within the lower pressure column;

(C) passing oxygen-richer fluid from the lower portion of the lower pressure column into the upper portion of a side column and producing oxygen-rich liquid within the side column;

(D) withdrawing nitrogen-enriched vapor from the higher pressure column, compressing the nitrogen-enriched vapor, and cooling the compressed nitrogen-enriched vapor by indirect heat exchange with oxygen-rich liquid to produce oxygen-rich vapor; and (E) recovering vaporized oxygen-rich liquid as product oxygen.

2. The method of claim 1 further comprising passing nitrogen-enriched fluid, after the indirect heat exchange with the oxygen-rich liquid, into at least one of the higher pressure column and the lower pressure column.

3. The method of claim 1 wherein the product oxygen is the oxygen-rich liquid vaporized by indirect heat exchange with the compressed nitrogen-enriched vapor.

4. The method of claim 1 wherein the product oxygen is oxygen-rich liquid vaporized by indirect heat exchange with feed air.

5. The method of claim 1 further comprising passing recovered product oxygen to a blast furnace.

6. Apparatus for producing oxygen comprising:

(A) a higher pressure column, a lower pressure column, means for passing feed air into the higher pressure column, and means for passing fluid from the higher pressure column to the lower pressure column;

(B) a side column and means for passing fluid from the lower portion of the lower pressure column to the upper portion of the side column;

(C) a compressor, a heat exchanger, means for passing fluid from the upper portion of the higher pressure column to the compressor and from the compressor to the heat exchanger;

(D) means for passing fluid from the lower portion of the side column to the heat exchanger; and (E) means for recovering fluid from the heat exchanger as product oxygen.

7. The apparatus of claim 6 further comprising means for passing fluid from the heat exchanger into at least one of the higher pressure column and the lower pressure column.

8. The apparatus of claim 6 wherein the side column has a bottom reboiler, further comprising means for passing fluid from the heat exchanger to the bottom reboiler.

9. The apparatus of claim 6 wherein the side column has a bottom reboiler and wherein the means for passing feed air into the higher pressure column includes the bottom reboiler.

10. The apparatus of claim 6 further comprising means for passing product oxygen to a blast furnace.

* * * * *